US005718386A

United States Patent [19]

Haug

[11] Patent Number: 5,718,386

[45] Date of Patent: Feb. 17, 1998

[54] FUEL INJECTION VALVE FOR INTERNAL COMBUSTION ENGINES

[75] Inventor: Stefan Haug, Leinfelden-Echterdingen, Germany

[73] Assignee: Robert Bosch GmbH, Stuttgart, Germany

[21] Appl. No.: 670,473

[22] Filed: Jun. 26, 1996

[30] Foreign Application Priority Data

Jun. 27, 1995 [DE] Germany ..... 195 23 243.7

[51] Int. Cl.[6] ..... F02M 47/00

[52] U.S. Cl. ..... 239/533.9; 239/600

[58] Field of Search ..... 239/533.2–533.12, 239/88–92, 600

[56] References Cited

U.S. PATENT DOCUMENTS

| | | | |
|---|---|---|---|
| 4,635,854 | 1/1987 | Ishibashi | 239/533.9 X |
| 4,669,668 | 6/1987 | Ogawa | 239/533.9 X |
| 5,165,607 | 11/1992 | Stevens | 239/533.9 X |
| 5,205,492 | 4/1993 | Khinchuk | 239/533.9 X |

FOREIGN PATENT DOCUMENTS

| | | | |
|---|---|---|---|
| 2925187 | 1/1981 | Germany | 239/533.9 |
| 4142430 | 7/1992 | Germany . | |
| 835500 | 1/1981 | U.S.S.R. | 239/600 |

*Primary Examiner*—Kevin Weldon
*Attorney, Agent, or Firm*—Edwin E. Greigg; Ronald E. Greigg

[57] ABSTRACT

A fuel injection valve for internal combustion engines, with a valve body tightened on a valve retaining body, a valve member is guided in a bore of the valve body so that the valve member can move axially and in which the bore has a radially enlarged pressure chamber into which at least one supply conduit which extends beside the bore feeds. An adjusting nut which braces the valve body against the valve retaining body with an inner, conically embodied annular shoulder rests against a conical annular step of the valve body. The annular step is disposed at a level of the pressure chamber. In order to achieve a precisely localized and reliable transmission of radial clamping forces onto the valve body, the angle (αD) formed by the conical annular step on the valve body with the valve member axis is smaller than the angle (αS) formed by the conical annular shoulder of the adjusting nut with this axis. An annular edge of the valve body, which is formed between the radially inner, lower end of the annular step and an annular face end, is continuously exposed.

3 Claims, 2 Drawing Sheets

FUEL INJECTION VALVE FOR INTERNAL COMBUSTION ENGINES

BACKGROUND OF THE INVENTION

The invention is based on a fuel injection valve for internal combustion engines. In standard fuel injection valves of this type, the fuel supply conduit in the valve body extends diagonal to its central axis, next to the guide bore for the valve member (nozzle valve), which bore extends coaxial to the central axis, and cuts laterally into the pressure chamber, which is embodied as an undercut and is formed by means of a cross sectional enlargement of the guide bore. As a result of the diagonal course of the supply conduit, the wall of the valve body between the supply conduit and the guide bore has only a small thickness near the mouth of the supply conduit into the pressure chamber. Moreover, the valve body wall which encompasses the pressure chamber has an extremely low thickness and stability because of the area required for distributing the fuel. At injection pressures of up to 400 bar, no damage of any consequence occurs in known fuel injection valves. At higher injection pressures, which today are increased up to approximately 1800 bar in direct-injection internal combustion engines, a fracture can occur at the end of the intermediary wall between the guide bore and the supply conduit (nip) of the pressure chamber, which with time can progress and can lead to the destruction of the valve body of the injection valve. In particular, fractures of this kind are due to the high dynamic internal pressure load in association with the static stress with which the valve body is clamped against the valve retaining body by the adjusting nut and the injection valve itself is pressed by the adjusting nut against a counterpart stop in the housing of the internal combustion engine. In fuel injection valves which are directly combined with a high pressure pump, so-called unit fuel injectors, a further factor is that when the pressure increases, the axial housing pressure of the pump is transferred to the valve member body via the retaining body.

In order to reduce the danger of valve body breakage in the region of the pressure chamber, German Offenlegungsschrift DE-OS 41 42 430 discloses the conical embodiment of the annular shoulder of the adjusting nut on its end remote from the retaining body, which nut axially braces the valve body against the retaining body, and the conical embodiment of the annular step on the valve body which cooperates with it, so that the bracing force of the adjusting nut when the valve body is tightened against the retaining body and the clamping force when the entire injection valve is clamped into the housing of the internal combustion engine are introduced onto the valve body in such a way that together, they counteract the compressive force of the pressure chamber, which is under high fuel pressure, in particular in the region of the nip at the entry of the supply conduit. In the known fuel injection valve, the cone angle of the conical faces on the valve body and on the adjusting nut are embodied as being the same size, which has the disadvantage of a very high manufacture expenditure for a level contact of the faces. In addition, at the adjusting nut and the valve body, an indefinite position of the conical faces of the valve body and the adjusting nut in relation to each other occurs when the valve body is tightened against the retaining body and when the injection valve is clamped into the housing of the internal combustion engine, as well as from the imposition of pressure on the pressure chamber in the valve body, so that the location of the force introduction onto the valve body cannot be optimally defined.

In addition, there is the danger that a large angular difference is produced between the conical annular step of the valve body and the conical annular step of the adjusting nut in such a way that the respective edge which defines the annular step of the valve body digs into the conical annular shoulder face of the adjusting nut, which is comprised of a softer material. The result of this is that the radial force introduction component on the valve body is greatly weakened and no longer sufficiently counteracts the expansion of the valve body and as a result, no longer counteracts a possible breakage of this valve body.

OBJECT AND SUMMARY OF THE INVENTION

The fuel injection valve for internal combustion engines according to the invention has the advantage over the prior art that a breakage of the valve body can be reliably prevented even at very high pressures (approximately 1800 bar) in the pressure chamber.

This is advantageously achieved by means of the design of the cone angle of the cooperating conical faces of the adjusting nut and the valve body; the angle of the conical annular step on the valve body to the valve member axis is embodied as smaller than the angle of the conical annular shoulder on the adjusting nut to the valve member axis. In this manner, an exactly localized and concentrated force introduction onto the valve body is achieved, which counteracts the compressive stress. In addition, an axial annular face end is provided on the valve body, which face end is formed between the radially inner end of the conical annular step face and the valve member shaft and which simplifies the manufacture of the conical face on the valve body. This also has the advantage that the annular edge, which is formed between the face end and the conical annular step, can be disposed in a region which definitely never comes into contact with the conical annular shoulder of the adjusting nut, and so the edge of the valve body is reliably prevented from digging into the adjusting nut. To that end, the conical annular shoulder face of the adjusting nut can advantageously also have two differently sloped annular shoulder regions; a region is then exposed which has a smaller angle to the valve member axis and is disposed on the radial inside.

The invention will be better understood and further objects and advantages thereof will become more apparent from the ensuing detailed description of a preferred embodiment taken in conjunction with the drawings.

DETAILED DESCRIPTION OF THE PREFERRED EMBODIMENTS

Figure 1:
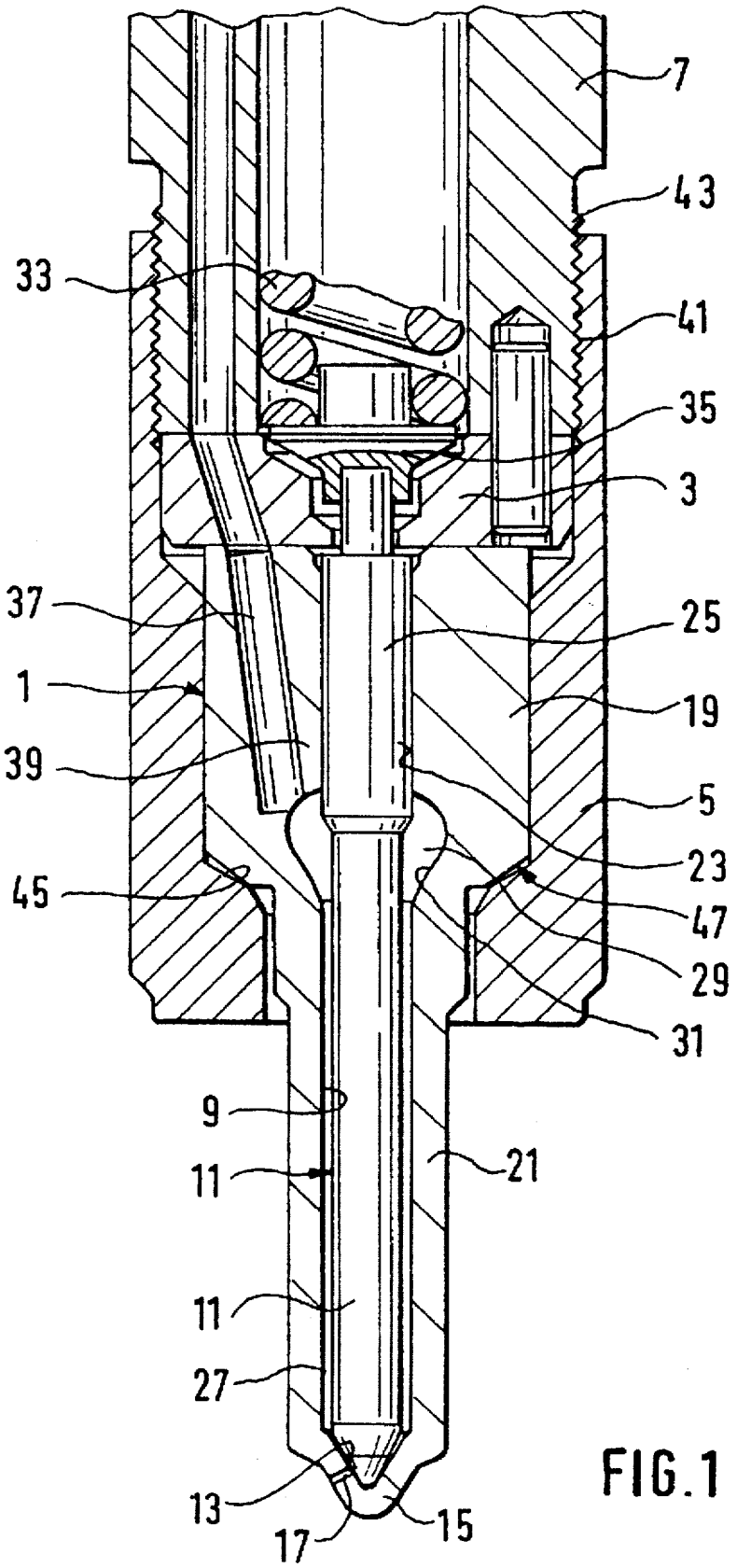
FIG. 1 shows a section through the part of the fuel injection valve on the combustion chamber end.

The fuel injection valve for internal combustion engines which is shown in FIG. 1 has a valve body 1, which is axially braced in a valve retaining body 7 by means of a sleeve-shaped adjusting nut 5 with the interposition of an intermediary disk 3. The valve body 1 has an axial bore 9, in which a piston-shaped valve member 11 is guided so that it can move axially; this valve member cooperates on one end with an inward-facing valve seat 13 located on the combustion chamber end in a tip 15, in which a plurality of injection openings 17 are disposed downstream of the valve seat 13. The valve body 1 is a rotationally symmetrical component with a thick upper section 19 and a thin lower shaft part 21 whose end oriented toward the combustion chamber is closed by the tip 15. The part of the bore 9 disposed in the upper section 19 is embodied as a guide bore 23 for the guide part 25 of the valve member 11. The part of the bore 9 which extends in the valve body shaft 21, together with the shaft of the valve member 11, defines an annular gap 27 which reaches to the valve seat 13. An undercut pressure chamber 29, which has an enlarged diameter, is disposed in the upper section 19, near the lower shaft part 21 between the guide bore 23 and the annular gap 27 of the bore 9; its outer boundary 31 is preferably cambered and merges into the annular gap 27. When the injection valve is closed, a closing spring 33, which is inserted into a blind bore of the valve retaining body 7, holds the valve member 11 in contact with the valve seat 13 via a spring plate 35.

For the purpose of supplying fuel, a supply conduit 37 extends in the upper, thicker section 19 of the valve body 1, leading from its upper face end, beside the guide bore 23 to the pressure chamber 29 and cuts into the pressure chamber laterally from above.

In order to keep the diameter of the pressure chamber 29 as small as possible and to keep the cross section of the mouth sufficiently large, the supply conduit 37 extends diagonal to the guide bore 23; the spacing of its inlet at the upper face end of the valve body 1 to the axis is greater than the spacing of its mouth into the pressure chamber 23 to this axis; hence the thickness of the intermediary wall 39 is small, near the mouth region of the supply conduit 37 and near the transition of the guide bore 23 into the pressure chamber 29.

The sleeve-shaped adjusting nut 5, which is embodied as a union nut and which is screwed with an internal thread 41 onto a threaded screw portion 43 on the valve retaining body 7 so that it overlaps the upper section 19 of the valve body 1, has an inner, conical annular shoulder 45 which supports the valve body 1 with a conical annular step 47 at the transition of the upper section 19 into the lower, slender shaft part 21.

Figure 2:
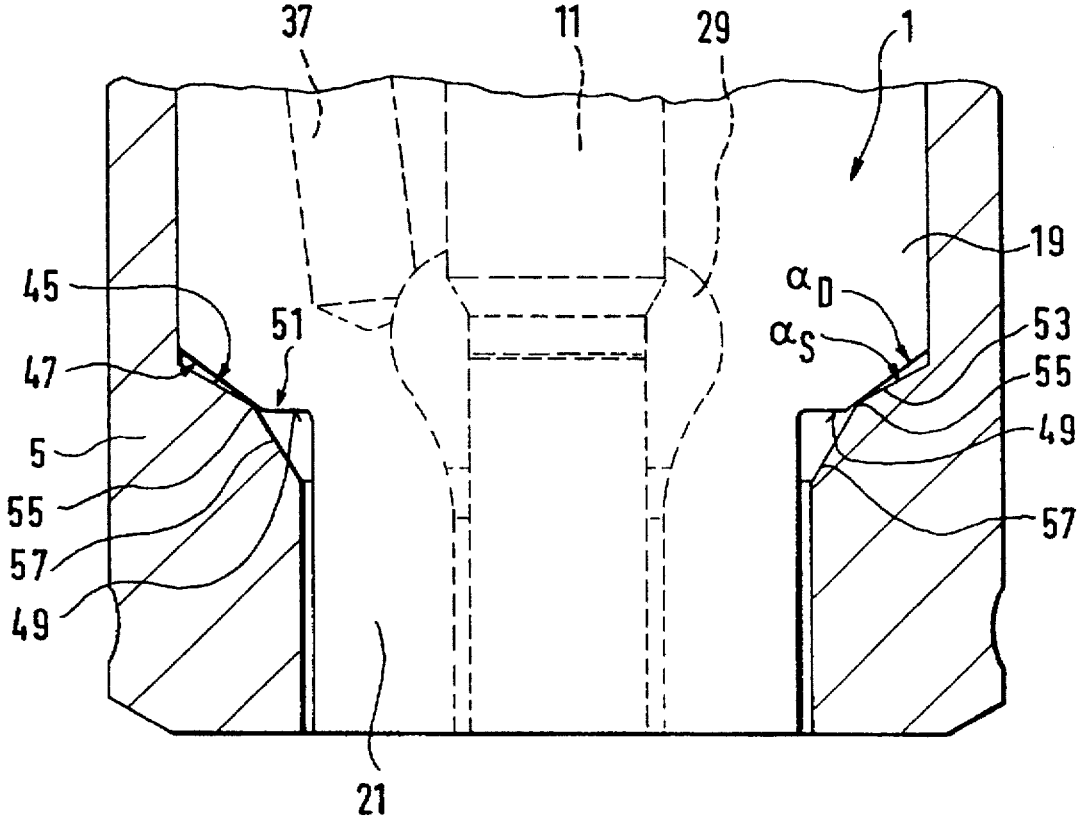
FIG. 2 shows an enlarged detail of the injection valve according to FIG. 1, in the region of the pressure chamber.

The embodiment, which is essential to the invention, of the annular shoulder 45, the adjusting nut 5, and the annular step 47 on the valve body 1 can be inferred from the enlarged section of the injection valve shown in FIG. 2.

The angle $\alpha D$ of the conical annular step 47 on the valve body 1 to the valve member axis is embodied as smaller than the angle $\alpha S$ of the conical annular shoulder 45 of the adjusting nut 5 to the valve member axis. In addition, at the transition between the lower, radially inner end of the conical annular step 47 and the shaft part 21, an annular face end 49 is provided on the valve body 1, which face end adjoins the conical annular step 47, forming an annular edge 51. In order to reliably prevent this annular edge 51 of the valve body 1, which is comprised of a very hard material, from digging into the face of the annular shoulder 45 of the adjusting nut 5, which is comprised of a softer material, the face of the conical annular shoulder 45 of the adjusting nut 5 is furthermore divided into two differently sloped annular shoulder regions. A radially outer annular shoulder region 53, which has the angle $\alpha S$, functions as a contact face for the conical annular step 47 of the valve body 1. This annular shoulder region 53 is adjoined via an edge 55 by a radially inner annular shoulder region 57, whose angle to the valve member axis is small in such a way that this annular shoulder region 57 is always exposed and starting at edge 55, does not come into contact with the valve body 1. The edge 55 is disposed radially outside the continuously exposed annular edge 51.

When the valve body 1 is axially braced against the valve retaining body 7 by means of the adjusting nut 5, both axial and radial forces are now introduced onto the valve body 1 by means of the conical contact faces; the radial forces counteract the stresses in the valve body 1 that when the injection valve is pressurized are produced by the internal pressure and by the introduction of axial forces, in particular in the region near the pressure chamber 29, a region that is critical in terms of breakage.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, comprising a valve body (1) tightened on a valve retaining body (7), a valve member (11) is guided in a bore (9) of the valve body, so that it moves axially and in which the bore (9) has a radially enlarged pressure chamber (29), at least one supply conduit (37) that extends beside the bore (9) feeds into the pressure chamber, an adjusting nut (5) braces the valve body (1) against the valve retaining body (7) with a conically embodied annular shoulder (45) which rests against a conical annular step (47) of the valve body (1), said annular step is disposed at a corresponding level of the pressure chamber (29), an angle ($\alpha D$) of the conical annular step (47) on the valve body (1) relative to the valve member axis is smaller than an angle ($\alpha S$) formed by the conical annular shoulder (45) of the adjusting nut (5) with this axis, and that between the radially inner end of the conical annular step (47) and a shaft part (21) of the valve body (1) which is smaller in diameter, an annular face end (49) is provided which merges into the face of the conical annular step (47) of the valve body (1), forming an annular edge (51), this annular edge being disposed outside the contact face of the conical annular shoulder (45) of the adjusting nut (5), which contact face cooperates with the conical annular step (47).

2. The fuel injection valve according to claim 1, in which the conical annular shoulder (45) of the adjusting nut (5) has two differently sloped annular shoulder regions of which a radially outer annular shoulder region (53), which forms the angle ($\alpha S$) with the valve member axis, cooperates with the annular step face (47) of the valve body (1), and a radially inner annular shoulder region (57) is exposed, which forms a smaller angle with this axis and adjoins the other annular shoulder region via an edge (55).

3. The fuel injection valve according to claim 2, in which the edge (55) between the radially outer and radially inner annular shoulder region of the adjusting nut (5) rests against the conical annular step face (47) of the valve body (1).

* * * * *